US006010998A

United States Patent [19]

Merchant, Jr. et al.

[11] Patent Number: 6,010,998

[45] Date of Patent: Jan. 4, 2000

[54] CLEANING COMPOSITION CONTAINING PINE OIL EXTENDERS

[75] Inventors: Philip Merchant, Jr., Katy; Kishore K. Chokshi, Houston; Ralph M. Kowalik, Kingwood, all of Tex.

[73] Assignee: Exxon Chemical Patents, Inc., Linden, N.J.

[21] Appl. No.: 08/854,824

[22] Filed: May 12, 1997

[51] Int. Cl.[7] ..... C11D 3/18; C11D 3/44

[52] U.S. Cl. ..... 510/463; 510/417; 510/365

[58] Field of Search ..... 510/410, 417, 510/463, 344, 365, 424, 506, 101, 238; 134/40

[56] References Cited

U.S. PATENT DOCUMENTS

| | | | |
|---|---|---|---|
| 4,060,496 | 11/1977 | Berliner . | |
| 4,123,378 | 10/1978 | Heinz et al. . | |
| 4,341,656 | 7/1982 | Abel | 252/321 |
| 4,584,113 | 4/1986 | Walsh | 252/45 |
| 4,867,898 | 9/1989 | Spaulding et al. . | |
| 5,281,354 | 1/1994 | Faber . | |
| 5,288,335 | 2/1994 | Stevens . | |
| 5,362,422 | 11/1994 | Masters . | |
| 5,376,297 | 12/1994 | Choy et al. . | |
| 5,534,198 | 7/1996 | Masters et al. . | |
| 5,591,708 | 1/1997 | Richter . | |

FOREIGN PATENT DOCUMENTS

| | | |
|---|---|---|
| 1120820 | 3/1982 | Canada . |
| 0 160 762 | 11/1985 | European Pat. Off. . |
| 0 748 865 | 12/1996 | European Pat. Off. . |

*Primary Examiner*—Yogendra Gupta
*Assistant Examiner*—Gregory E Webb
*Attorney, Agent, or Firm*—Ohlandt, Greeley, Ruggiero & Perle

[57] ABSTRACT

Pine oil cleaning compositions containing as extenders $C_9$ to $C_{12}$ olefins, $C_9$ to $C_{12}$ alcohols and acetates thereof. The extenders permit replacement of a portion of the pine oil constituents in cleaning compositions while preserving bloom and cleaning characteristics.

12 Claims, No Drawings

CLEANING COMPOSITION CONTAINING PINE OIL EXTENDERS

FIELD OF THE INVENTION

This invention relates to pine oil cleaning compositions permitting reduced levels of pine oil. More particularly, this invention relates to improved pine oil cleaning compositions especially useful for cleaning hard surfaces and wherein the cleaning compositions have present extenders which permit a reduction of the level of pine oil required to obtain a given level of cleaning without a corresponding reduction in bloom or micro emulsion stability.

BACKGROUND OF THE INVENTION

Cleaning compositions for cleaning hard surfaces such as metal, glass, porcelain, enamel, ceramic, plastic, linoleum and like surfaces are well known and commercially available in a wide variety of forms. A particular category of cleaning compositions useful for such a purpose comprises liquid pine oil cleaning compositions. In fact, liquid pine oil cleaning compositions have found widespread use and acceptance for many years as hard surface cleaners to remove greasy, fatty and oily soils on hard surfaces. However, pine oil cleaning compositions have suffered from the drawback that the cost of pine oil fluctuates between moderate and unduly high levels as a result of a rather limited or tight supply situation.

Therefore, there is a need to provide extender compounds that can be used in place of a part of the pine oil component in pine oil cleaning compositions yet still enable the resulting compositions to have generally the same cleaning capabilities as if the amount of pine oil component had not been reduced. Additionally, there is a need for lower cost extender compounds for pine oil cleaning compositions that provide good compatibility in concentrate form and provide compositions with excellent bloom properties, so as to retain their consumer acceptability.

SUMMARY OF THE INVENTION

Liquid pine oil cleaning compositions in which the amount of pine oil needed can be reduced are provided in this invention by pine oil cleaning compositions containing, as extenders for the pine oil at least one about $C_9$ to $C_{12}$ olefin, provided that when a $C_{12}$ olefin is present in such a cleaning composition it is used in combination with about $C_9$ to $C_{12}$ olefin in an amount such that the $C_{12}$ olefin does not exceed 50% by weight of the olefin mixture, or at least one linear or branched $C_9$ to $C_{12}$ monohydric alcohol or acetates thereof; preferably oxo alcohols or acetates thereof, wherein the composition exhibits the following properties: excellent bloom at a 1:50 ratio dilution of said composition in deionized water, and a stable micro emulsion when the olefin, alcohol or acetate is included in the composition at an olefin to pine oil weight ratio between about 1:20 to 1:1.

The invention further provides concentrated pine oil cleaning compositions in which a portion of the pine oil is replaced by one of the aforementioned about $C_9$ to $C_{12}$ olefin or $C_9$ to $C_{12}$ monohydric alcohols or acetates thereof as extenders. The concentrated pine oil cleaning compositions of this invention, with the aforesaid extenders present, form stable micro emulsions when the extenders are included in the cleaning compositions in an amount up to about 50% or more by weight based on the weight of pine oil present in the composition. The concentrated pine oil cleaning compositions of this invention with the aforesaid extenders present in an amount up to 20 about 50% or more by weight based on the weight of pine oil also provide pine oil cleaning compositions having good bloom properties when the concentrate is diluted in deionized water at a pine oil concentrate to water ratio of 1:50.

DETAILED DESCRIPTION OF THE INVENTION

Pine oil cleaning compositions of this invention and concentrates thereof are based on compositions containing a pine oil component as the major active constituent. Pine oil generally used in such compositions has a boiling point range from about 180° C. to 225° C. and is a colorless to light amber liquid having as its chief constituents tertiary and secondary terpene alcohols and is generally obtained by distilling the oils extracted from pine wood, cones and needles.

Any suitable pine oil may be employed in the cleaning compositions and concentrates of this invention. Especially suitable are pine oils which are presently commercially available. Among those commercially available there may be mentioned Unipine® 60, which is believed to contain approximately 60% terpene alcohols; Unipine® S-70, which is believed to contain approximately 70% terpene alcohols; Unipine® S and Unipine® 80, both believed to contain approximately 80% terpene alcohols; Unipine® 85, which is believe to contain approximately 85% terpene alcohols; Unipine® 90, which is believed to contain approximately 90% terpene alcohols; as well as Alpha Terpineol 90, which is believed to contain approximately 100% terpene alcohols; all available from Union Camp Corp. of Wayne, N.J. Other suitable commercially available pine oils include Glidco® Pine Oil 60, believed to contain approximately 60% terpene alcohols; Glidco® Pine Oil 140, believed to contain approximately 70% terpene alcohols; Glidco® Pine Oil 80, believed to contain approximately 80% terpene alcohols; Glidco® Pine Oil 150, believed to contain approximately 85% terpene alcohols; Glidco® Terpene SW, believed to contain approximately 75% terpene alcohols; as well as Glidco® Terpineol 350, believed to contain approximately 100% terpene alcohols; all available from Glidco Organics Corp. of Jacksonville, Fla.

The pine oil will generally be present in the concentrate compositions in an amount up to about 20% by weight, generally in an amount of from about 5% to 20% by weight.

The olefin extenders of this invention comprise olefins containing from about 9 to 12 carbon atoms. The olefins can be any olefin containing about 9 to 12 carbon atoms and will preferably comprise a mixture of $C_9$ to $C_{12}$ olefins. Any suitable $C_9$ to $C_{12}$ olefin can be employed in the pine oil cleaning compositions and concentrates of this invention. Any suitable nonene, decene, undecene and dodecene may be employed. However, when a dodecene is employed as an extender, it is utilized as a mixture combined with at least one about $C_9$ to $_{11}$ olefin and the $C_{12}$ olefin will not comprise more than about 50% by weight of the olefin mixture.

Preferred olefin extenders include a mixture of olefins comprising, by weight, from about 5% to 15% $C_9$ olefin, from about 45% to 55% $C_{10}$ olefin, from about 25% to 35% $C_{11}$ olefin and from about 5% to 15% $C_{12}$ olefin, and nonene.

Also as extenders, there can be employed linear or branched $C_9$ to $C_{12}$ monohydric alcohols and acetates thereof As examples of such monohydric alcohols there may be mentioned n-nonunol, isononunol, n-decanol, isodecanol, n-undecanol, isoundecanol, n-dodecanol, isododecanol and other nonunols, decanols, undecanols, dodecanols and $C_9$ to $C_{12}$ oxo alcohols and mixtures thereof.

A preferred class of monohydric alcohol are the oxo alcohols. Oxo alcohols are manufactured via a process, whereby propylene and other olefins are oligomerized over a catalyst (e.g. a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are monohydric oxo alcohols which have a carbon number in the range between about $C_9$ to $C_{12}$. It is desirable to have a branched oxo alcohol comprising multiple isomers, preferably more than 3 isomers, most preferably more than 5 isomers.

Branched oxo alcohols may be produced in the so-called "oxo" process by hydroformylation of commercial branched $C_8$ to $C_{11}$ olefin fractions to a corresponding branched $C_9$ to $C_{12}$ alcohol/aldehyde-containing oxonation product. In the process for forming oxo alcohols, it is desirable to form an alcohol/aldehyde intermediate from the oxonation product followed by conversion of the crude oxo alcohol/aldehyde product to an all oxo alcohol product The production of branched oxo alcohols from the cobalt catalyzed hydroformylation of an olefinic feedstream preferably comprises the following steps:

(a) hydroformylating an olefinic feedstream by reaction with carbon monoxide and hydrogen (e.g. synthesis gas) in the presence of a hydroformylation catalyst under reaction conditions that promote the formation of an alcohol/aldehyde-rich crude reaction product;

(b) demetalling the alcohol/aldehyde-rich crude reaction product to recover therefrom the hydroformylation catalyst and a substantially catalyst-free, alcohol/aldehyde-rich crude reaction product; and (c) hydrogenating the alcohol/aldehyde-rich crude reaction product in the presence of a hydrogenation catalyst (e.g. massive nickel catalyst) to produce an alcohol-rich reaction product.

The olefinic feedstream is preferably any $C_8$ to $C_{11}$ olefin. Moreover, the olefinic feedstream is preferably a branched olefin, although a linear olefin which is capable of producing all branched oxo alcohols is also contemplated herein. The hydroformylation and subsequent hydrogenation in the presence of an alcohol-forming catalyst, is capable of producing branched $C_9$ to $C_{12}$ alcohols. Each of the branched oxo $C_9$ to $C_{12}$ alcohols formed by the oxo process typically comprises, for example, a mixture of branched oxo alcohol isomers, e.g. 3,5 dimethyl heptanol; 4,5-dimethyl heptanol; 3,4-dimethyl heptanol; 5-methyl octanol; 4-methyl octanol; 3,5-dimethyl octanol; 5-methyl decanol; 3,4-dimethyl decanol; 4-methyl undecanol and mixtures of other methyl and dimethyl heptanols, octanols, decanols and undecanols. Especially preferred are $C_9$ to $C_{12}$ oxo alcohols.

Also useful as extenders are the acetic acid esters of the aforementioned $C_9$ to $C_{12}$ monohydric alcohols. Preferred are the acetates of $C_9$ to $C_{12}$ alcohols, especially acetates of $C_9$ to $C_{12}$ oxo alcohols.

The extenders can be used in pine oil cleaning compositions to partially replace the pine oil constituent of the compositions. Although the amount of pine oil constituent replaceable in the compositions can vary from extender to extender, and from formulation to formulation, in general, the extenders of this invention can be employed to replace up to about 50% by weight of pine oil, preferably between about 5 to 20% by weight The actual amount employed will depend on the maximum amount replaceable and the desired level of performance (cleaning ability, bloom, etc.). It is preferably that the extender be added in an amount such that the pine oil cleaning composition exhibits the following properties: excellent bloom at a 1:50 ratio dilution of the composition in deionized water, and a stable micro emulsion when the extenders is included in the composition at an extender to pine oil weight ratio between about 1:20 to 1:1, more preferably between about 1:20 to 1:5.

The maximum amount of pine oil that can be replaced by a particular extender or mixture of extenders depends on the particular concentrate formulation, its type and level of surfactants, and any co-solvents present. A convenient way to estimate the relative replacement potential of various extenders is to measure the maximum amount of extender which can be added to fully formulated commercial pine cleaner concentrates without breaking the micro emulsion. This amount can be determined by adding given amounts of extender into a pine oil concentrate composition, shaking the mixture vigorously, and determining if the mixture returns to a clear micro emulsion within about 30 seconds, preferably within about 15 seconds, after shaking has ceased. If the mixture returns to such a micro emulsion, the given amount of extender can likely be employed to replace the pine oil. However, if the mixture forms a cloudy macro emulsion, the extender is considered incompatible at the given level and the given level is probably not an acceptable level of pine oil replacement. This technique provides an approximate ranking of the replacement potential of the various extenders. Those skilled in the art can readily appreciate that actual replacement values may be higher when formulations are optimized.

Additionally, the extenders, when employed in concentrated pine oil cleaning compositions at an acceptable replacement level, should also permit the pine oil concentrate with the given level of extender therein to produce an acceptable bloom when the concentrate composition is diluted in water at a dilution ratio generally employed in the use of such cleaning composition, i.e. a dilution ratio of pine oil concentrate to water of about 1:50. The degree of bloom or turbidity formed upon dilution will generally depend on the hardness of the water with lower concentrations of divalent cations resulting in higher degrees of bloom.

It will also be appreciated that the extenders, when employed in the cleaning compositions to replace a portion of the pine oil, should produce a cleaning composition that is essentially as good as or better than a pine oil cleaning composition without the extenders. The cleaning powers of the diluted cleaning compositions can be estimated from surface tension measurements of the diluted mixture taken according to the procedure of ASTM D1331. A value for the diluted mixture equal to or less than the control (pine oil cleaner composition without an extender of this invention) is indicative of no loss in cleaning power for the diluted mixtures containing the extenders of this invention.

It is also desirable that the pine oil cleaners and concentrates with the extenders of this invention function similar to the original formulations without extenders. In this regard, the extender should have a boiling point range generally similar to pine oil, which typically has a boiling point range of from about 180° C. to 220° C.

It will be appreciated that the pine oil cleaning compositions of this invention may also contain other ingredients typical of such cleaning compositions, such as, for example, the compositions may contain one or more of the following constituents: solubilizing agents, germicidal agents, viscosity modification agents, fragrances, foaming agents, surfactants, water softening agents, coloring agents. Such additional optional ingredients should be selected so as to have insignificant or no detrimental effects upon the cleaning and blooming characteristics of the compositions. Such optional or additional components will generally comprise up to about 20% by weight of the concentrate composition, but will generally be present in a lesser amount, i.e. up to about 10% or less.

As examples of germicidal agents that may be included in the cleaning compositions of this invention, there may be mentioned quaternary ammonium compounds and salts thereof.

Exemplary quaternary ammonium salts include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ether linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyl-trimethyl ammonium chloride, chlorinated dodecylbenzyltrimethyl ammonium chloride, and the like.

Such quaternary germicides are usually sold as mixtures of two or more different quaternaries, such as BARDAC® 205M, which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quaternary germicide is CYNCAL® 80%, which is believed to comprise 80% by weight of an alkyl dimethyl benzylammonium chloride (50% C14, 40% $C_{12}$ and 10% C16 alkyl), 10% water and 10% ethanol. Further useful quaternary germicidal agents include BTC-8358®, and alkyl benzyl dimethyl ammonium chloride (80% active) and BTC-818®, a dialkyl dimethyl ammonium chloride. Additional suitable commercially available quaternary ammonium germicides of the alkyl dimethyl benzylammonium chloride type containing the same alkyl dimethyl benzylammonium chloride mixture as that of CYNCAL® and which are generally referred to as quaternary salts include BARQUAT® MB 80, which is believe to be and 80% by weight solution (20% ethanol) of the quaternary; HYAMINE® 1622, which is believe to be an aqueous solution of benzethonium chloride, and HYAMINE® 3500, which is believed to be a 50% aqueous solution of the quaternary. BARDAC®, BARQUAT® and HYAMINE® germicides are available from Lonza, Inc., Fairlawn, N.J.; CYNCAL® germicides from Hellon Davis Chemical Co,, Cincinnati, Ohio and BTC germicides from Stepan Chemical Co., Chicago, Ill.

A further optional, but desirable constituent includes fragrances, natural or synthetically produced. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom.

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amounts to improve or impart to concentrate compositions an appearance characteristic of a pine oil type concentrate composition, such as a color ranging from colorless to a deep amber, deep amber yellow or deep amber reddish color. Such a coloring agent or coloring agents may be added in any useful amounts in a conventional fashion, i.e. admixing to a concentrate composition or blending with other constituents used to form a concentrate composition. However, other colors atypical of pine oil type cleaning concentrates may be used as well.

As an optional constituent, it is to be understood that the concentrate compositions of the invention may also include one or more surface active agents which may be an anionic, cationic, nonionic, amphoteric or zwitterionic surface active agents or surfactants which may be found useful in providing good dispersive properties, and or additional dispersive properties to the compositions. Mixtures of one or more of these surface active agents are well known to the art and exemplary compositions are described in McCutcheon's Detergents and Emulsifiers, North American Edition, 1982; Kirk-Othmer, Encyclopedia of Chemical Technology, 3rd Ed., Vol. 22, pp. 346–387, the contents of which are herein incorporated by reference thereto. Mixtures of two or more such surface active agents may be incorporated into the inventive compositions.

One class of surface active agents which may be used, include nonionic surfactant compositions, such as those which may be characterized as condensation products or alkylene oxide groups with an organic hydrophobic compound, such as an aliphatic or alkyl aromatic compounds. Such compounds include those which may be characterized as nonionic surfactants based on alkoxylated alkyl phenols. These include ethoxylated and propoxylated fatty alcohols, as well as ethoxylated and propoxylated alkyl phenols, both with alkyl chains of about 7–16, more preferably about 8–13 carbon chains in length. Exemplary alkoxylated alcohols include certain linear alcohol ethoxylates presently commercially available under the general trade name Neodol®, alkoxylated alkyl phenols including certain octyl and nonyl phenol compositions available under the trade name of Igepal® from Rhône-Poulenc Inc., Cranbury, N.J., and secondary alcohol ethoxylates available under the general trade name Tergitol® from Union Carbide Corporation, Danbury, Conn.

Exemplary anionic surface active agents include compounds known to the art as useful as anionic surfactants. These include, but are not limited to, alkali metal salts, ammonium salts, amine salts, aminoalcohol salts or the magnesium salts of one or more of the following compounds: alkyl sulfates, alkyl ether sulfates, akylamidoether sulfates, allylaryl polyether sulfates, monoglyceride sulfates, alkylsulfonates, alkylamide sulfonates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isothionates, and N-acyl taurates. Generally, the alkyl or acyl radical in these various compounds comprises a carbon chain containing 12 to 20 carbon atoms.

Further exemplary anionic surface active agents which may be used include fatty acid salts, including salts of oleic, ricinoleic, palmitic, and stearic acids, copra oils or hydrogenated copra oil acid, and acyl lactylates whose acyl radical contains 8 to 20 carbon atoms.

Other anionic surface active agents not particularly enumerated here may also find use in conjunction with the compounds of the present invention. The addition of one or more anionic surface active agents may be desired as it is known that this class of surface active agents, viz., surfactants, are known to be useful in facilitating the removal or stains or soils from surfaces.

What is to be understood by the term "concentrate" and "concentrate composition" in this specification and claims is the pre-consumer dilution and composition of the cleaning composition which is essentially the form of the product prepared for sale to the consumer or other end user. Such a consumer or other end user would then normally be expected to dilute the same with water to form a cleaning composition. It is to be understood, however, that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surface cleaning applications.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate: water, and optionally, agitating the same to ensure even distribution of the concentrate in the water. As noted, the concentrate may be used without dilution, i.e., in concentrate to water concentrations of 1:0, to extremely dilute dilutions such as 1:10,000. Desirably, the concentrate is diluted in the range of about 1:0.1–1:1000, preferably in the range of about 1:1–1:500, and most preferably in the range of about 1:10–1:100. The actual dilution selected is in part determinable by the degree and amount of dirt and grime to be removed from a surface(s), the amount of mechanical force imparted to remove the same, as well as the observed efficacy of a particular dilution. Generally, better results and faster removal is to be expected at lower relative dilutions of the concentrate in the water.

Cleaning compositions in accordance with this invention can be prepared by any suitable means of mixing the constituents together. No particular order of mixing the constituents appears to be necessary. Thus, two or more of the constituents may be mixed or blended together by conventional means, such as a stirrer (mechanically, electrically, magnetically or manually driven), to form a partial premixture which may be added to an appropriate amount of water. Alternatively, each of the constituents, in any order, may be added to an amount of water under stirring after which any additional required amount of water may be subsequently added to make up a formulation within the weight ranges described above.

The invention is illustrated by but not limited to the following examples.

EXAMPLES 1–11

The compatibility of the extender solvents of this invention and their ability to replace a portion of pine oil in pine oil concentrates and cleaning compositions was tested in the following manner.

Extenders of this invention were added to 10 g of Pine Sol® concentrate, broad spectrum formula, having 19.9% pine oil present. The extenders were added in amounts from 0.1 g to 0.7 g (5% to 35% based on the amount of pine oil or 1 to 7% based on the total concentrate formulation) in 0.1 g increments. The test tubes were shaken vigorously. If the shaken mixture returned to a clear, amber micro emulsion in about 15 seconds or less after shaking ceased, the formulation was considered stable and the amount of extender present could likely be used to replace a corresponding amount of pine oil. If the shaken mixture formed a milky macro emulsion which persisted for several minutes or longer, the mixture was considered incompatible. Table I reports the percentage of pine oil replaceable by extenders of this invention by reporting the stable percentage of extender concentration based on the pine oil present in the concentrate.

The ability of the cleaning concentrate compositions to produce the desired blooming effect was tested by adding 1 ml of the concentrate containing the extender to 50 ml of deionized water in a jar and visually rating the appearance against a control of 1 ml of neat Pine Sol® concentrate in 50 ml of deionized water. The control formed an opaque cloud or "bloom" throughout most of the jar and was rated excellent. In the table, poor indicates almost no bloom, fair represents a translucent "bloom" and good represents a relative bloom between fair and excellent.

The potential cleaning powers of the diluted mixtures of this invention were evaluated by measuring the surface tension according to the methodology of AS TM D1331. A surface tension value about equal to or less than the surface tension value of the control (32 mN/m) is indicative of no significant loss in cleaning power due to the presence of the extenders.

For comparison purposes, test results for several saturated aliphatic hydrocarbon extenders are included.

TABLE 1

| Example Number | Extender | Stable @ X% Extender added to Pine Oil | Bloom @ 1:50 Dilution | Surface tension @ 1:50 Dilution (mN/m) | Boiling Point Range(° C.) |
|---|---|---|---|---|---|
| Control (Pine So1 ®) | — | — | excellent | 32 | — |
| 1 | Nonene | 10 | excellent | 33 | 136–146 |
| 2 | Olefin Blend[1] | 10 | excellent | 33 | 136–178 |
| 3 | Dodecene | 10 | excellent | 33 | 177–203 |
| 4 | $C_9$ oxo alcohol | >35 | excellent | — | 200–217 |
| 5 | $C_{10}$ oxo alcohol | 20 | excellent | 31 | 215–224 |
| 6 | $C_{12}$ oxo alcohol | 10 | excellent | 31 | 235–266 |
| 7 | $C_{10}$ oxo alcohol acetate | 5 | excellent | 31 | 220–250 |
| 8 | $C_{12}$ oxo alcohol acetate | 5 | excellent | — | 233–271 |
| 9 | Olefin Blend[1]/$C_9$ oxo alcohol (50:50) | 20 | excellent | — | — |
| 10 | Olefin Blend[1]/$C_{10}$ oxo alcohol (50:50) | 15 | excellent | — | — |
| 11 | Olefin Blend[1]/$C_{12}$ oxo alcohol (50:50) | 10 | excellent | — | — |
| Comparative A | Isopar ® G[2] | 10 | good | 33 | 160–176 |
| Comparative B | Isopar M[3] | 10 | poor | 32 | 222–254 |
| Comparative C | Exxsol ® D60[4] | 10 | fair | 32 | 187–210 |
| Comparative D | Exxsol D80[5] | 10 | fair | 33 | 207–234 |
| Comparative E | Norpar ® 12[6] | 5 | fair | 33 | 188–220 |

[1]Denotes a mixed olefin stream containing nominally 5 to 15% $C_9$, 45 to 55% $C_{10}$, 25 to 35% $C_{11}$ and 5 to 15% $C_{12}$ olefins.
[2]Denotes a commercial hydrocarbon product containing predominantly $C_9$ to $C_{11}$ iso paraffins.
[3]Denotes a commercial hydrocarbon product containing predominantly $C_{12}$ to $C_{15}$ iso paraffins.
[4]Denotes a commercial hydrocarbon product containing predominantly $C_{10}$ to $C_{13}$ mixed paraffins.
[5]Denotes a commercial hydrocarbon product containing predominantly $C_{11}$ to $C_{14}$ mixed paraffins.
[6]Denotes a commercial hydrocarbon product containing predominantly $C_{10}$ to $C_{13}$ normal paraffins.

The results in the Table demonstrate that the olefin, alcohol and alcohol acetate extenders of this invention are able to replace a significant proportion of pine oil in pine oil cleaning compositions yet still retain the necessary bloom characteristics and cleaning power. In contrast, the saturated aliphatic hydrocarbons cannot produce the necessary bloom characteristics when replacing pine oil.

With the foregoing description of the invention, those skilled in the art will appreciate that modifications may be made to the invention without departing from the spirit thereof. Therefore, it is not intended that the scope of the invention be limited to the specific embodiments illustrated and described.

We claim:

1. A liquid pine oil cleaning composition which is a pine oil concentrate composition, comprising:

a pine oil in an amount of about 5 to 20% by weight of the concentrate composition;

at least one extender selected from the group consisting of about $C_9$ to $C_{12}$ olefins, $C_9$ to $C_{12}$ monohydric alcohol and acetates thereof, and mixtures thereof provided that when a $C_{12}$ olefin is present, the $C_{12}$ olefin is combined with other about $C_9$ to $C_{11}$ olefins in an amount of $C_{12}$ olefin not to exceed 50% by weight of the olefin mixture; wherein the extender comprises a mixture of about 5% to 15% $C_9$ olefins, about 45% to 55% $C_{10}$ olefin, about 25% to 35% $C_{11}$ olefins and about 5% to 15% $C_{12}$ olefin; and water, wherein said concentrate composition when diluted in a further amount of water in a ratio of cleaning concentrate composition to further amount of water of about 1:50 exhibits excellent bloom properties.

2. A pine oil cleaning composition according to claim 1 wherein the extender comprises a mixture of $C_9$ to $C_{12}$ olefins and a $C_9$ to $C_{12}$ oxo alcohol.

3. A pine oil cleaning composition according to claim 1 wherein the extender comprises a $C_9$ to $C_{12}$ oxo alcohol and an olefin which is a mixture of from about 5% to 15% $C_9$ olefin, about 45% to 55% $C_{10}$ olefins, about 25% to 35% $C_{11}$ olefins and about 5% to 15% $C_{12}$ olefins.

4. A composition according to claim 1 wherein said composition exhibits the following property: a stable micro emulsion when said olefin is included in said composition at an olefin to pine oil weight ration between about 1:20 to 1:1.

5. A composition according to claim 1 wherein said olefin is selected from a $C_{10}$ olefin, a $C_{11}$ olefin and mixtures thereof.

6. A composition according to claim 1 wherein said pine oil is present in said composition in an amount of between about 5% to 20 wt. %.

7. A composition according to claim 1 wherein said alcohol is a $C_9$ to $C_{12}$ oxo alcohol comprising multiple isomers and wherein said composition exhibits the following properties: excellent bloom at a 1:50 ratio dilution of said composition in deionized water, and a stable micro emulsion when said alcohol or acetate thereof is included in said composition at an alcohol to pine oil weight ratio between about 1:20 to 1:1.

8. A composition according to claim 7 wherein said oxo alcohol comprises at least 3 isomers.

9. A composition according to claim 7 wherein said oxo alcohols are formed from the cobalt catalyzed hydroformylation of a $C_8$ to $C_{11}$ olefinic feedstream.

10. A composition according to claim 1 comprising an acetate of a monohydric $C_9$ to $C_{12}$ alcohol.

11. A concentrated liquid pine oil cleaning composition which comprises:

a pine oil;

at least one olefin selected from the group consisting of about $C_9$ to $C_{12}$ olefins, provided that when a $C_{12}$ olefin is present the $C_{12}$ olefin is combined with other about $C_9$ to $C_{11}$ olefins in an amount of $C_{12}$ olefin not to exceed about 50% by weight of the olefin mixture; and at least one monohydric alcohol or acetate selected from the group consisting of $C_9$ to $C_{12}$ alcohols and acetates thereof; wherein said composition exhibits the following properties: excellent bloom at a 1:50 ratio dilution of said composition in deionized water; and a stable micro emulsion when said olefin and alcohol or acetate thereof is included in said composition at an olefin and alcohol or acetate thereof to pine oil weight ratio between about 1:20 to 1:1.

12. A composition according to claim 11 which comprises an olefin which is a mixture of about 5% to 15% $C_9$ olefins, about 45% to 55% $C_{10}$ olefins, about 25% to 35% $C_{11}$ olefins, about 5% to 15% $C_{12}$ olefins and an alcohol which is an oxo alcohol.

* * * * *